US012203716B2

(12) United States Patent
Geissele et al.

(10) Patent No.: US 12,203,716 B2
(45) Date of Patent: Jan. 21, 2025

(54) RIFLING PROFILE FOR FIREARMS

(71) Applicant: WHG PROPERTIES, LLC, North Wales, PA (US)

(72) Inventors: William H. Geissele, Lower Gwynedd, PA (US); Ralph E. Dilemmo, Norristown, PA (US); Eric Binter, Sussex, NJ (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

(21) Appl. No.: 18/152,223

(22) Filed: Jan. 10, 2023

(65) Prior Publication Data

US 2024/0230265 A1 Jul. 11, 2024

(51) Int. Cl.
*F41A 21/18* (2006.01)

(52) U.S. Cl.
CPC ..... *F41A 21/18* (2013.01)

(58) Field of Classification Search
CPC ..... F41A 21/18
USPC ..... 42/78; 89/14.7
See application file for complete search history.

(56) References Cited

U.S. PATENT DOCUMENTS 1,230,712 A * 6/1917 Holter ..... F41A 21/18 42/78
1,275,028 A * 8/1918 Holter ..... F41A 21/18 42/78
2,293,114 A * 8/1942 Carter ..... F41A 21/18 89/14.05
3,643,364 A 2/1972 Koch
3,786,589 A 1/1974 Kaltmann
9,212,860 B2 12/2015 Kunau
9,939,223 B1 * 4/2018 Heizer ..... F41A 19/38
2012/0180362 A1 7/2012 Feddersen
2015/0007479 A1 1/2015 Kunau
(Continued)

FOREIGN PATENT DOCUMENTS

EP 3742103 A1 11/2020
FR 2223654 A1 10/1974
(Continued)

OTHER PUBLICATIONS

Wikipedia, polygonal v. normal Rifling [retrieved from Internet Feb. 13, 2023] <https://en.wikipedia.org/wiki/Polygonal_rifling#/media/File:Polygonalvs_normal_rifling.svg> (1 page).
(Continued)

*Primary Examiner* — Bret Hayes
(74) *Attorney, Agent, or Firm* — Alston & Bird LLP

(57) ABSTRACT

A firearm barrel is provided having a body defining an outer surface and a bore. The bore may define a rifling profile along at least a portion of a length of the barrel. The rifling profile may define a cross-sectional profile perpendicular to the length of the barrel at a location along the length of the barrel. The cross-sectional profile may include a plurality of arcuate portions and a plurality of linear portions. The cross-sectional profile may define a cross-sectional area defined by a Sporting Arms and Ammunition Manufacturers' Institute (SAAMI) standard rifling profile. Various embodiments may include firearms, assemblies, components, and methods associated with such firearms and firearm barrels.

20 Claims, 7 Drawing Sheets

(56) References Cited

U.S. PATENT DOCUMENTS

| | | | | |
|---|---|---|---|---|
| 2015/0338184 | A1* | 11/2015 | White | F41A 21/30 89/14.4 |
| 2016/0209146 | A1* | 7/2016 | Smith | F41A 21/18 |
| 2022/0187041 | A1* | 6/2022 | Caudle | F41A 21/18 |

FOREIGN PATENT DOCUMENTS

| | | |
|---|---|---|
| GB | 1409331 | 10/1975 |
| WO | WO 2003/023310 A1 | 3/2003 |
| WO | WO 2009/056848 A1 | 5/2009 |

OTHER PUBLICATIONS

International Search Report and Written Opinion for PCT/US2023/031295 (ISA/EP) mailed Dec. 15, 2023 (14 pages).

* cited by examiner

RIFLING PROFILE FOR FIREARMS

GOVERNMENT LICENSE RIGHTS

This invention was made with government support under a Cooperative Research and Development Agreement for Novel Gun Barrel Design and Manufacturing awarded by the United States Army. The government has certain rights in the invention.

TECHNICAL FIELD

Example embodiments relate generally to firearms, and, more particularly, to rifling for use in firearm barrels and associated firearms, assemblies, components, and methods regarding the same.

BACKGROUND

Rifles and other types of firearms may be equipped with a barrel and bolt that, in conjunction, hold or support a cartridge during operation of the firearm (e.g., within a chamber). A magazine contains the cartridges that are fed from the magazine to the chamber by the bolt during operational cycles of the firearm action. Cycling of the firearm bolt may be performed manually by an operator (e.g., a bolt action rifles) or by way of an autoloading action (e.g., automatic or semi-automatic rifles).

Discharging a firearm, via ignition of a propellent, sends a projectile from the muzzle end of the barrel to the exit end of the barrel. Rifling is used on the inside of the barrel to impart spin onto the projectile and improve accuracy and precision. The rifling my cause wear on the projectile causing the projectile to become inaccurate. Similarly, repeated use may cause a barrel to fatigue due, in part, to friction between the projectiles and the barrel. Through applied effort, ingenuity, and innovation, Applicant has solved problems relating to firearm barrel performance by developing solutions embodied in the present disclosure, which are described in detail below.

BRIEF SUMMARY

The present disclosure relates to a firearm barrel, rifling, firearms, and corresponding components, systems, and methods. Various embodiments of the present disclosure may include a firearm barrel. The firearm barrel may include a body defining an outer surface and a bore. The bore may define a rifling profile along at least a portion of a length of the barrel. The rifling profile may define a cross-sectional profile perpendicular to the length of the barrel at a location along the length of the barrel. The cross-sectional profile may include a plurality of arcuate portions and a plurality of linear portions. The cross-sectional profile may define a cross-sectional area defined by a Sporting Arms and Ammunition Manufacturers' Institute (SAAMI) standard rifling profile.

In some embodiments at least a portion of the bore, including a first portion of the bore at the location, is coated with a coating. The coating may include chrome.

In some embodiments, the plurality of arcuate portions and the plurality of linear portions may include alternating arcuate portions and linear portions. The plurality of arcuate portions and the plurality of linear portions may include an equal number of the arcuate portions and the linear portions.

The plurality of arcuate portions and the plurality of linear portions may include six arcuate portions and six linear portions.

In some embodiments, a diameter of the bore spanning two opposite arcuate portions of the plurality of arcuate portions may be defined as a diameter of a projectile for which the barrel is sized.

In some embodiments, a narrowest diameter of the bore at the location is 97.5% to 97.8% of a largest diameter of the bore at the location. The narrowest diameter may be defined between two opposite linear portions and the largest diameter may be defined between two opposite arcuate portions.

In some embodiments, the barrel may be configured to fire a .277 Fury or 6.8×51 mm cartridge, and the barrel may define a narrowest diameter of the bore at the location of 0.265 inches and a largest diameter of the bore at the location of 0.277 inches.

In some embodiments, the barrel may be sized to fire M855 or M193 cartridges.

In some embodiments, the cross-sectional area may be 0.0388 square inches.

Various embodiments may include a firearm. The firearm may include a receiver; a trigger assembly; a buttstock; and a barrel. The barrel may include a body defining an outer surface and a bore. The bore may define a rifling profile along at least a portion of a length of the barrel. The rifling profile may define a cross-sectional profile perpendicular to the length of the barrel at a location along the length of the barrel. The cross-sectional profile may include a plurality of arcuate portions and a plurality of linear portions. The cross-sectional profile defines a cross-sectional area defined by a Sporting Arms and Ammunition Manufacturers' Institute (SAAMI) standard rifling profile.

In some embodiments, at least a portion of the bore, including a first portion of the bore at the location, is coated with a coating. The coating may include chrome.

In some embodiments, the plurality of arcuate portions and the plurality of linear portions may include alternating arcuate portions and linear portions. The plurality of arcuate portions and the plurality of linear portions may include an equal number of the arcuate portions and the linear portions. The plurality of arcuate portions and the plurality of linear portions may include six arcuate portions and six linear portions.

In some embodiments, a narrowest diameter of the bore at the location is 97.5% to 97.8% of a largest diameter of the bore at the location. The narrowest diameter may be defined between two opposite linear portions and the largest diameter may be defined between two opposite arcuate portions.

The above summary is provided merely for the purposes of summarizing some example embodiments to provide an understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be described below. Other features, aspects, and advantages of the subject will become apparent from the description, the drawings, and the claims.

BRIEF DESCRIPTION OF THE DRAWINGS

Having thus described embodiments of the disclosure in general terms, reference will now be made to the accompanying drawings, which are not necessarily drawn to scale.

The following drawings are illustrative of particular embodiments of the present disclosure and do not limit the scope of the present disclosure. Moreover, the drawings are intended for use in conjunction with the explanations provided herein. Example embodiments of the present disclosure will hereinafter be described in conjunction with the appended drawings.

Figure 1:
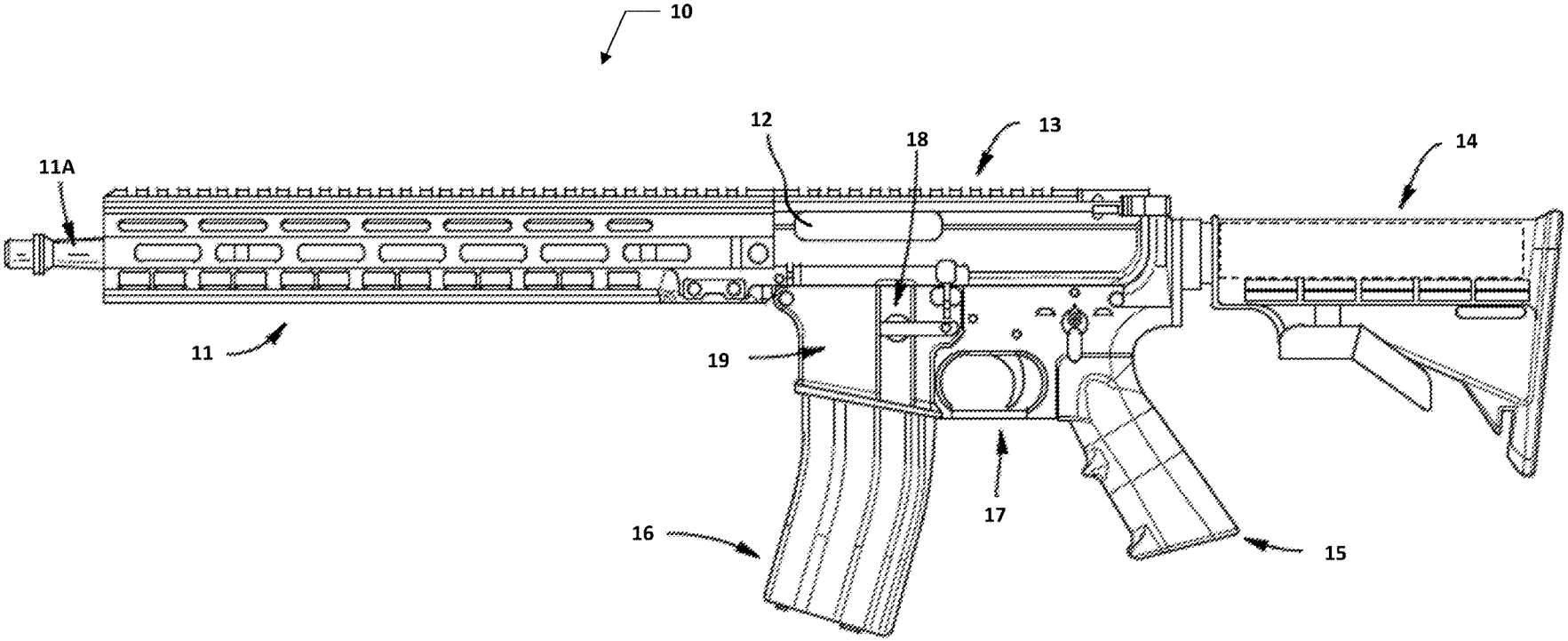

FIG. 1 illustrates a side view of a firearm in accordance with some embodiments of the present disclosure.

Figure 2:
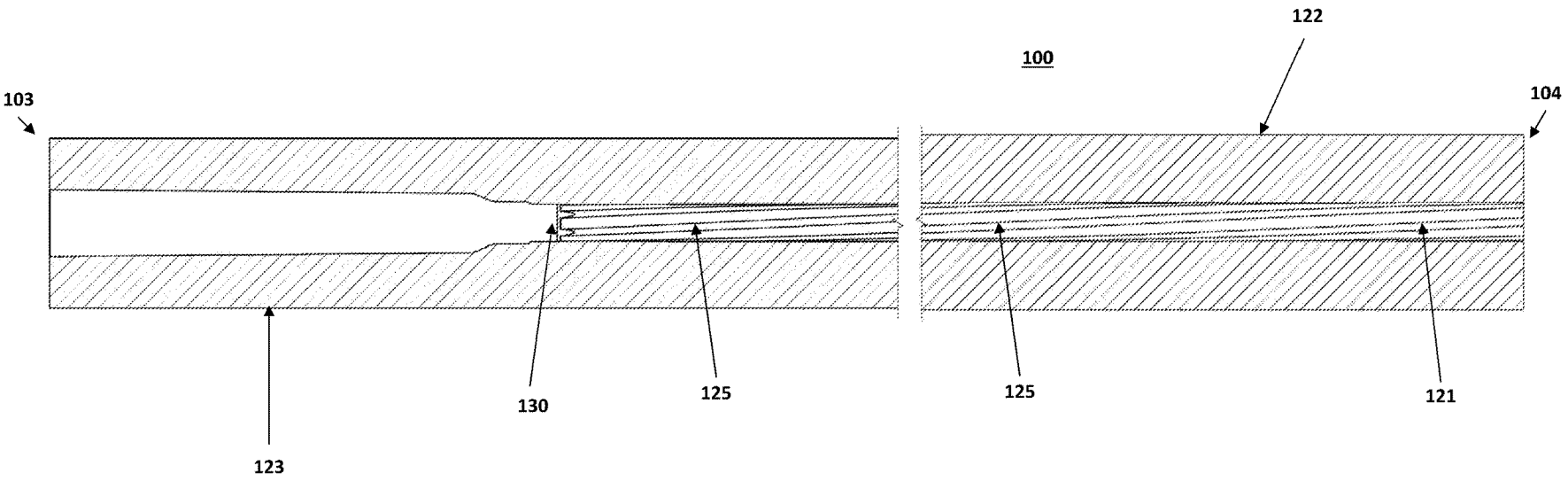

FIG. 2 illustrates a side, cross-sectional view of a portion of a barrel in accordance with some embodiments of the present disclosure.

Figure 3B:
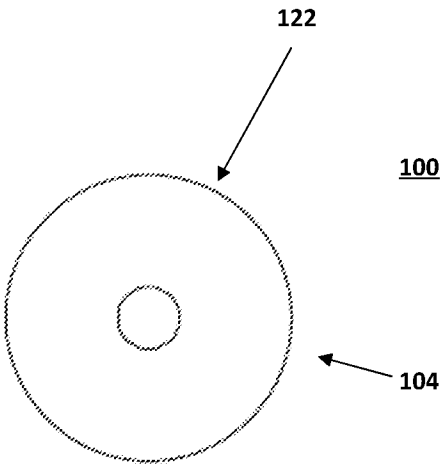
Figure 3A:
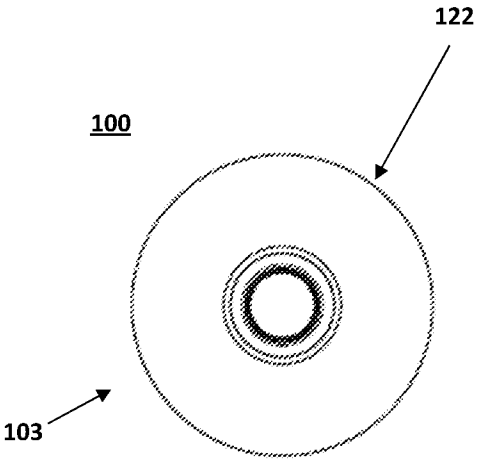

FIG. 3A illustrates a rear view of a barrel from a chamber end in accordance with some embodiments of the present disclosure.

FIG. 3B illustrates a front view of a barrel from a muzzle end in accordance with some embodiments of the present disclosure.

Figure 4:
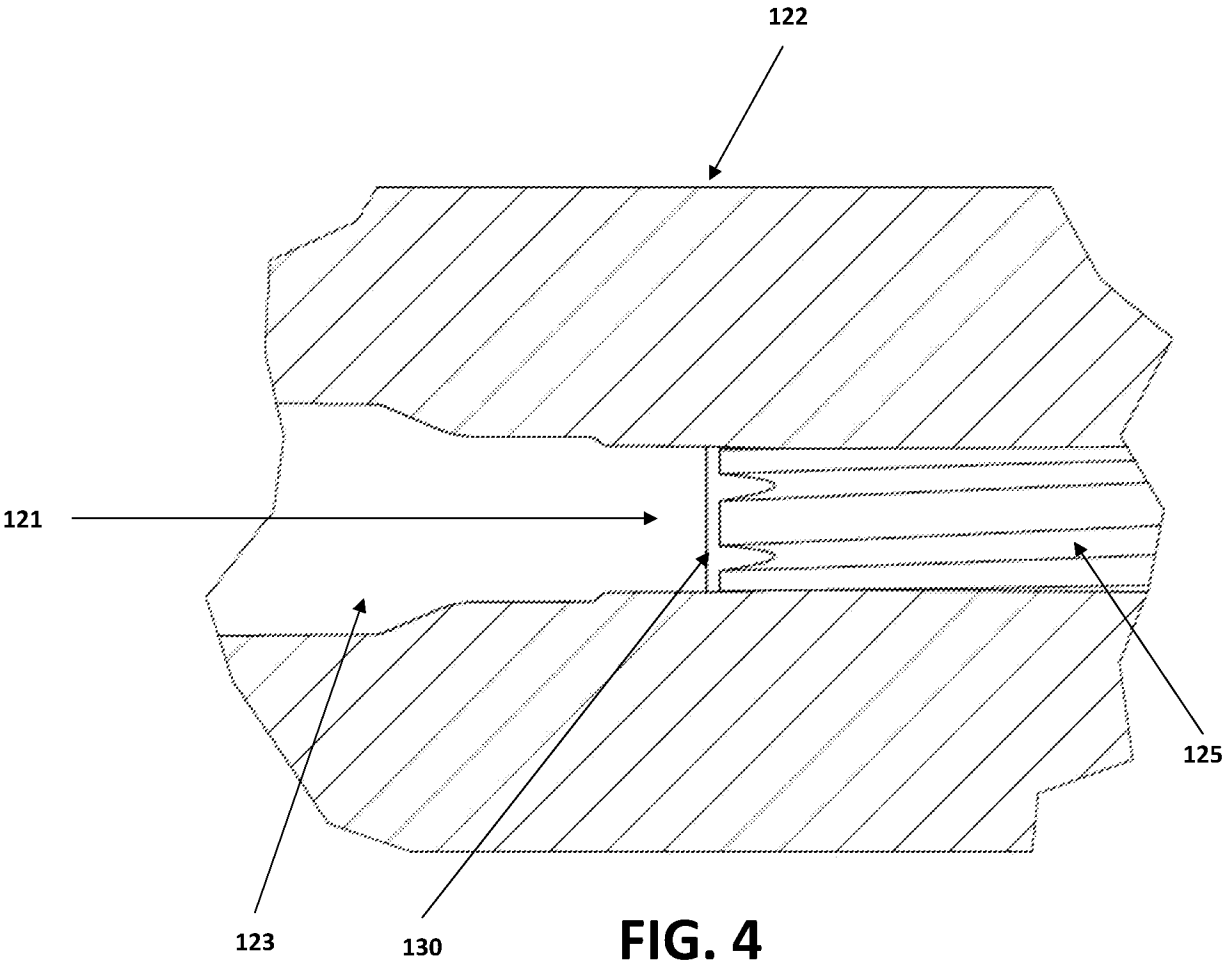

FIG. 4 illustrates a cross-sectional side view of a portion of a barrel including a chamber end and the start of a rifling profile in accordance with some embodiments of the present disclosure.

Figure 5:
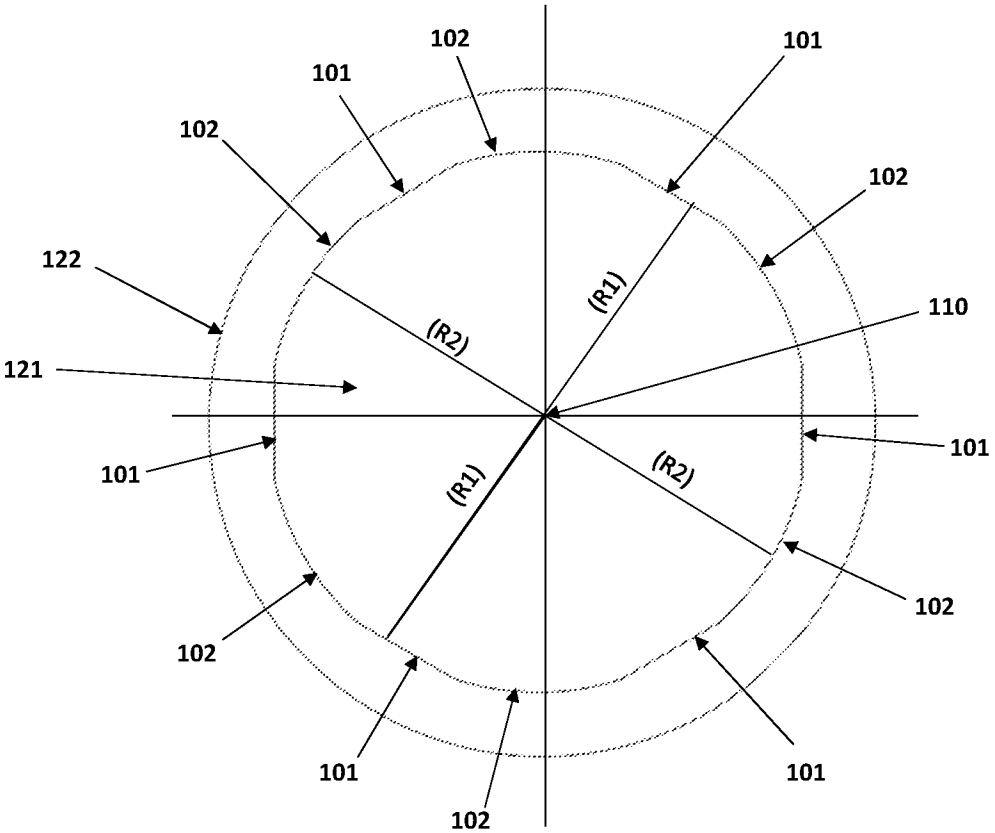

FIG. 5 illustrates a front cross-sectional view of the barrel illustrating a cross-sectional profile of the rifling profile in accordance with some embodiments of the present disclosure.

Figure 6B:
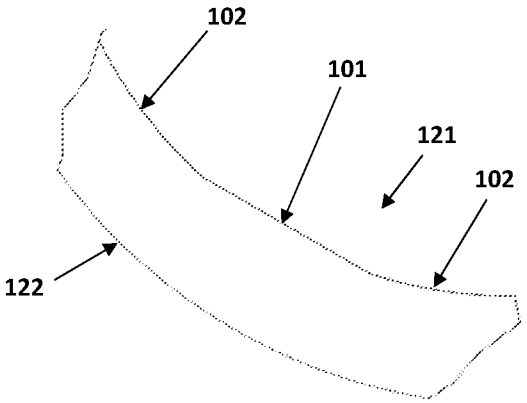
Figure 6A:
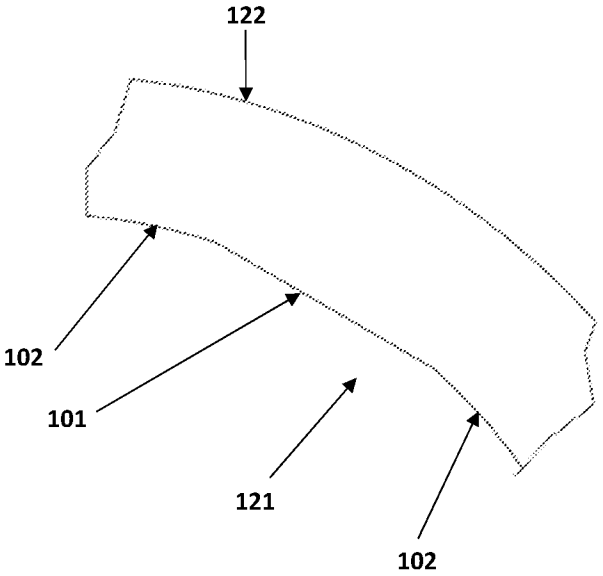

FIGS. 6A-6B illustrate detail views of the cross-sectional view of FIG. 5.

Figure 7:
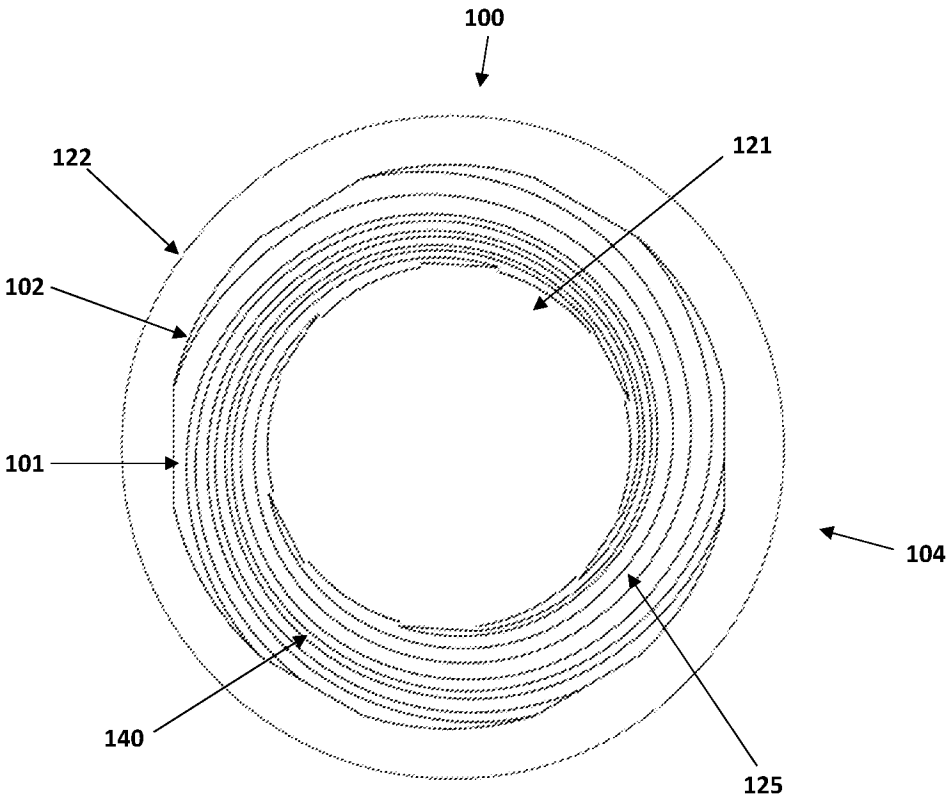

FIG. 7 illustrates a front perspective view of the barrel viewed from the muzzle in accordance with some embodiments of the present disclosure.

DETAILED DESCRIPTION

Some embodiments of the present disclosure will be described in a more detailed manner hereinafter with reference to the accompanying drawings, in which some, but not all, embodiments of the disclosure are shown. Indeed, this disclosure may be embodied in many different forms and should not be construed as limited to the embodiments set forth herein; rather, these embodiments are provided so that this disclosure will satisfy applicable legal requirements. Like numbers may refer to like elements throughout.

As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. Thus, use of any such aforementioned terms, or similarly interchangeable terms, should not be taken to limit the spirit and scope of embodiments of the present invention.

As used herein, terms such as "front," "rear," "top," etc. are used for explanatory purposes in the examples provided below to describe the relative positions of certain components or portions of components and should not be construed to require absolute positions relative to the earth or another reference point outside of the described assemblies and components. As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. The use of such terms is inclusive of and is intended to allow independent claiming of specific values listed. Thus, use of any such aforementioned terms, or similarly interchangeable terms, should not be taken to limit the spirit and scope of embodiments of the present invention. As used in the specification and the appended claims, the singular form of "a," "an," and "the" include plural references unless otherwise stated. The terms "includes" and/or "including," when used in the specification, specify the presence of stated feature, elements, and/or components; it does not preclude the presence or addition of one or more other features, steps, operations, elements, components, and/or groups thereof.

Terms such as "example", "illustrative", and "exemplary" when used herein, are intended to mean "serving as an example, instance, or illustration." Any implementation described herein as an "example" or "exemplary embodiment" is not necessarily preferred or advantageous over other implementations. If the specification states a component, feature, or structure "can," "may," "could," "should," "would," "preferably," "possibly," "typically," "optionally," "for example," "often," or "might," or other such language, be included or have a characteristic, that component, feature, or structure is not required to be included or to have the characteristic. Such component, feature, or structure may be optionally included in some embodiments, or it may be excluded. The phrases "in one embodiment," "according to one embodiment," and/or the like generally mean that the particular feature, structure, or characteristic following the phrase may be included in at least one embodiment of the present disclosure and may be included in more than one embodiment of the present disclosure (importantly, such phrases do not necessarily refer to the same embodiment).

The figures of the current embodiment of the invention are not necessarily drawn to scale and are provided to illustrates some examples of the invention described. The figures are not to limit the scope of the present disclosure or the appended claims. Aspects of various example embodiments are described below with reference to the figures for illustration. One of ordinary skill in the art recognize the example embodiments can be practice without one or more specific details and/or with other methods.

During operation of a firearm, a firing mechanism (e.g., a trigger assembly, hammer, and firing pin) may cause ignition of a propellant in the cartridge. The expanding gases from the ignited propellant may propel a projectile (e.g., a bullet) from the cartridge and down the barrel of the firearm and out a muzzle end of the barrel. For example, a cartridge containing the projectile (e.g., the bullet) may be stripped from a magazine by a bolt and fed into a chamber of the barrel as the firearm cycles, either manually or as the bolt returns forward during an autoloading action. An inner surface of the barrel at the chamber may support a casing of the cartridge during ignition of the propellent.

Distal of the chamber, towards the muzzle end, the barrel may include a rifling profile comprising a plurality of arcuate portions and linear portions forming a spiral pattern along the length of the barrel. At least some portions of the rifling profile may contact the projectile as the expanding gases drive the projectile down the barrel to impart a spin on the projectile. The imparted spin may provide stability to the projectile during flight to improve the precision and accuracy of the projectile at the cost of friction between the projectile and barrel. Standard rifling includes sharp plateaus, also referred to as "lands", separated by grooves, which are effective at imparting spin onto the projectile but often cause damage to the projectile and/or the barrel due, at least in part, to the impingement of the projectile on the sharp edges of the rifling. Moreover, internal coatings, such as chroming, may be impossible or ineffective in a standard rifled barrel because the chroming may not adhere to the sharp angles within the barrel.

The present disclosure relates to a flatform barrel rifling which may improve performance of the firearm while reducing wear on the barrel and/or projectile. The flatform barrel rifling may comprise a smoother cross-sectional profile, with a plurality of arcuate portions connecting a plurality of linear portions around the circumference of the bore. As a result, the barrel may have no or reduced "engraving" of the projectile (e.g., removing of material as the projectile contacts the rifling) and reduced friction between the projectile and barrel compared to a standard rifling profile. In some embodiments, projectiles that typically experience poor performance in a standard barrel, such as projectiles having aerodynamic and/or structural flaws, may experience even greater performance increases with the flatform barrel rifling in accordance with embodiments of the present disclosure. Similarly, polygonal rifling, including multiple flat sides joined to each other with minimal or no transition, can experience poor performance and are generally disfavored even relative to standard rifling. Various embodiments of the flatform barrel rifling disclosed herein may, for example, reduce wear on the projectile and increase the longevity of the barrel.

With reference to FIG. 1, a firearm 10 is shown with a barrel 11 configured with flatform barrel rifling in accordance with embodiments of the present application. In the depicted embodiment, the firearm 10 may include a barrel 11; an upper receiver 13; a lower receiver assembly 19; a magazine 16; a grip 15; a trigger guard 17; an action including a bolt carrier group (e.g., bolt, firing pin, ejector, etc.) within the receivers 13, 19; an autoloading system (e.g., gas driven system (gas direct gas impingement, gas piston, etc.) recoil-driven autoloader, inertia-driven autoloader, etc.); a buttstock 14; magazine catch 18; ejection port 12; and/or other firearm components that would be appreciated in light of the present disclosure.

In some embodiments, the firearm may be an AR-15 platform weapon configured to fire any of the cartridges disclosed herein or known in the art to be usable with an AR-15 platform weapon. Although illustrated and described hereafter with reference an example AR-15 platform weapon, the present disclosure contemplates that the flatform barrel rifling may be used with a barrel of any firearm or any firearm platform (e.g., an AR platform, an AK-47 platform, an AK-74 platform, a .50 caliber platform, automatic firearms, semi-automatic firearms, bolt-action firearms, among others) for any purpose (e.g., hunting rifles, military rifles, enthusiast rifles, target rifles, competition rifles, etc.). Furthermore, a "firearm" of the present disclosure may refer to any device configured to fire a projectile regardless of size or manner of operation, such as 50+ caliber firearms regardless of mounting position or use, anti-material rifles, vehicle armaments, armored fighting vehicles (e.g., tanks and main battle tank main guns, armored cars, armored personnel carriers, infantry fighting vehicles, etc.), artillery devices (e.g., mid-level artillery), and/or the like.

With reference to FIGS. 2-7, various views of an example embodiment of a flatform barrel rifling profile for a barrel 100 according to the present disclosure is illustrated. The barrel 100 may comprise an outer surface 122 and a bore 121, and the barrel 100 may define a first end 103 (e.g., a chamber end) and a second end 104 (e.g., a muzzle end) axially opposite the first end 103 along the length of the barrel. With reference to FIGS. 2 and 4, the barrel 100 may comprise a chamber 123 for receiving the cartridge therein. The chamber end 103 of the barrel may comprise threading or one or more other attachment means for engaging a barrel extension and/or receiver of the firearm. FIGS. 3A-3B respectively illustrate chamber end 103 and muzzle end 104 views of the barrel 100.

In the depicted embodiments, the barrel 100 may define a rifling profile 125 along at least a portion of the length of the bore 121. With reference to FIGS. 2 and 4, the bore 121 may define a transition 130 at the chamber-side start of the rifling profile 125 at a location distal to the chamber 123. The transition 130 may comprise a throat, which is the depicted cylindrical section before the leade, which is the depicted tapered section that connects to the rifling. In some embodiments, as discussed herein, the arcuate portions of the rifling profile may match the exterior curve of the projectile and/or the barrel prior to start of the rifling profile and the linear portions of the rifling profile may extend radially inward of the arcuate portions. In one or more embodiments, the rifling profile may define the cross-sectional profile having a cross-sectional area taken perpendicular to the axial length of the example barrel 100.

With reference to FIG. 5, an example cross-sectional profile of the rifling profile 125 is shown, where the cross-section is taken perpendicular to the center axis 110 of the barrel. In the depicted embodiment, the bore 121 comprises a plurality of linear portions 101 and a plurality of arcuate portions 102 in the cross-sectional profile, which define a cross-section of the rifling profile 125. In the depicted embodiment, the linear portions 101 and arcuate portions 102 alternate around the circumference of the bore 121 with linear portions disposed between each pair of arcuate portions and arcuate portions disposed between each pair of linear portions in an alternating manner. Each linear portion 101 may be followed by an arcuate portion 102, wherein the pattern may be repeated for the whole circumference of the bore 121 creating the cross-sectional profile of the rifling profile. The depicted embodiment includes six arcuate portions 102 and six linear portions 101. In some embodiments, the rifling profile 125 may comprise six or more of each of the arcuate portions and linear portions. In some embodiments, the rifling profile 125 may comprise fewer than six of each of the arcuate portions and linear portions. In some embodiments, the rifling profile 125 may comprise three or more of each of the arcuate portions and linear portions. In some embodiments, the rifling profile 125 may comprise five or more of each of the arcuate portions and linear portions. In some embodiments, the rifling profile 125 may comprise twelve or more of each of the arcuate portions and linear portions. Larger caliber barrels (e.g., .50 caliber or artillery barrels) may have a greater number than smaller caliber barrels.

In the depicted embodiment, the linear portions 101 form chords between points at the ends of the respective adjacent arcuate portions 102. The junctions between each respective linear portion 101 and arcuate portion may be smooth, with the respective linear portions 101 extending linearly between arcuate portions 102 without the raised edges of a standard barrel rifling. In some embodiments, the arcuate portions 102 of the cross-sectional profile may collectively define a constant radius of curvature (R2) relative to the center axis 110 of the bore 121. In some embodiments, the arcuate portions 102 may be arcs along a circumference of a circle, with the linear portions 101 forming chords therebetween. The linear portions 101 may define a narrowest radius (R1) at their closest point to the center axis 110. The linear portions 101 may be symmetrical, such that the closest point is at the center of each linear portion, with the radius gradually increasing to the radius of curvature (R2) of the arcuate portions at the edges of the linear portion on either side of the center. In the depicted embodiment, the radius (R1) associated with the closest point on linear portions 101 to the center axis 110 is less than the radius (R2) associated with the arcuate portions 102. In some embodiments, each arcuate portion 102 may be identical and each linear portion 101 may be identical. In some embodiments, the angular width of each arcuate portion 102 and each linear portion 101 may be equal (e.g., each segment may be 30 degrees wide in embodiments having six arcuate portions 102 and six linear portions). In some embodiments, the barrel may include at least one gas port along its length intersecting an arcuate portion and/or a linear portion to feed propellant gas back to the action for cycling the firearm.

The Sporting Arms and Ammunition Manufacturers' Institute (SAAMI) produces specifications for dimensions of firearms, including dimensions associated with a standard rifling profile (e.g., a land and groove embodiment having plateaus separated from grooves by sharp transitions and elevated side walls). The present inventors discovered that the flatform barrel rifling discussed herein and shown, for example, in FIG. 5 can be manufactured with a cross-sectional profile having a cross-sectional area equal to a SAAMI cross-sectional area for a standard rifling profile, in each instance with the two areas being defined for a particular projectile or cartridge. For example, the cross-sectional area of the cross-sectional profile of the bore 121 shown in FIG. 5 may be 0.0388 square inches in an instance in which the barrel 100 is configured for .223 cartridges, which corresponds to the SAAMI standard rifling profile for a .223 cartridge.

In the depicted embodiment, a diameter of the bore 121 may be defined across the center axis 110, with a diameter at the linear portions 101 being less than a diameter at the arcuate portions (2 times R2). In various embodiments, the arcuate portions 102 may be defined at a predetermined diameter and/or radius relative to the projectile (e.g., equal to a respective projectile diameter and/or radius) while at least part of the linear portions 101 may define diameter that is narrower than the projectile. For example, the diameter of the barrel 100 between arcuate portions 102 may be 0.227 inches for a 227 Fury cartridge. In some embodiments, the arcuate portions 102 may be defined at the bullet diameter (e.g., aligned with the outer perimeter of the bullet), with the linear portions narrower than the bullet diameter at their midpoint. In some embodiments, the arcuate portions 102 may be defined inside (e.g., narrower than) the bullet diameter (e.g., 0.0005" narrower). For example, the arcuate portions for a 5.7×28 may be defined at a 0.2213" diameter while the bullet diameter is 0.224. In some embodiments, the arcuate portions 102 may be defined outside (e.g., greater than) the bullet diameter. Although reference is made herein to a "diameter", the arcuate portions need not be disposed across from each other relative to a center axis of the barrel (e.g., for odd numbered rifling), such that the actual distance across the center axis of the barrel may be less than the "diameter" because the actual measured distance intersects one arcuate portion and one linear portion while the "diameter" may be defined relative to a hypothetical barrel determined relative to a cylindrical projectile and/or two hypothetical arcuate portions across from each other (e.g., double the radius measured to a single point versus a true measurement across the barrel).

In various embodiments, the diameter of the bore 121 in the cross-sectional profile may be narrower between adjacent linear portions 101. For example, in the embodiment depicted in FIG. 5, the diameter between closest points to the center axis 110, with the diameter intersecting the center axis, is two times R1. In various embodiments, a narrowest diameter through the center axis (e.g., 2 times R1) may be equal to 97.5%-97.8% of the largest diameter through the center axis (e.g., 2 times R2, or an equivalent smoothbore), wherein the larger diameter may be defined by opposing arcuate portions 102 in an instance in which the arcuate portions are opposite each other. In various embodiments, the stated cross-sectional areas may be a minimum percent of area of the diameter of a smoothbore at the arcuate portion diameter determined to not cause pressure issues in the barrel during firing. The cross-sectional area may be independent of the number of arcuate portions and linear portions in the barrel rifling profile. Thus, in the embodiment depicted in FIG. 5, this may mean that R1 is 97.5%-97.8% of R2.

By way of nonlimiting example, in one or more embodiments, a barrel 100 may be configured to fire a .277 Fury or 6.8×5.1 mm cartridge, wherein the narrowest diameter of the bore 121 in a cross-sectional profile (e.g., 2 times R1) may be equal to 0.270 inches and a largest diameter (e.g., 2 times R2) may be equal to 0.277 inches. In such embodiment, the cross-sectional area of the cross-sectional profile may equal a SAAMI standard rifling profile cross-sectional area for the .277 Fury or 6.8×5.1 mm cartridge. In another example embodiment, the barrel 100 may be configured to receive a 5.56×46 mm M193 projectile. In some embodiments, the barrel 100 may be configured to receive a 5.56×46 mm M855 projectile. In various embodiments, the barrel may be configured for any cartridge and/or projectile, including, but not limited to, 5.56 mm, 6 mm, 6.5 mm and 7.62 mm at a cross-sectional area percentage at or above the SAAMI standard rifling profile minimum cross-sectional area. In various embodiments, the examples described above, the cross-sectional areas for each barrel 100 may correspond to a SAAMI standard rifling profile cross-sectional area despite a difference in shape to a standard rifling profile.

With reference to FIGS. 2, 4, and 7, the rifling profile 125 may extend along the length of the barrel 101 and the respective linear portions 101 and arcuate portions 102 may spiral along the length of the barrel to impart rotation on the projectile. In some embodiments, the barrel may have any twist rate, including, but not limited to, 1-7 for 5.56 mm projectiles, 1-7.5 for 6 mm projectiles, 1-7.5 for 6.5 mm projectiles, and 1-8 for 7.62 mm projectiles. Along the length of the barrel, each cross-sectional profile will appear to rotate about the center axis 110 depending on the axial position at which the cross-section is taken. Thus, the absolute positions of the linear and arcuate portion will change (e.g., spiral to create the rifling twist) for various cross-sectional profiles along the length of the barrel. In some embodiments, the relative positions between the arcuate and linear portions may remain constant for some or all of the length of the rifling profile 125. In some embodiments, following the transition (e.g., transition 130 shown in FIGS. 2 and 4) the relative positions and sizes of the linear and arcuate portions may remain constant for the length of the rifling profile. In various embodiments, the flatform rifling profile 125 may be configured to extend from at least the transition 130 to the muzzle end 104 of the barrel 100, as depicted in FIG. 7.

In various embodiments, the bore 121 may be coated to improve the durability of the barrel. A coating may provide additional wear resistance to increase the longevity of the barrel 100 and/or reduce damage to the projectile while increasing performance of the barrel. For example, one or more coatings may be applied to reduce unnecessary friction between the barrel and the projectile, improving the muzzle velocity of the projectile, the accuracy of the projectile (e.g., by reducing wear on the projectile in the barrel), and increasing the longevity of the barrel both in the short term (e.g., by reducing heat transfer into the barrel due to friction during a firing session) and in the long term (e.g., by reducing the heat, force, and wear on the barrel per shot). Standard rifling profiles include sharp edges between lands and adjacent grooves, which cause poor adhesion of coating materials; however, embodiments of the present barrel 100 and rifling profile 125 may adhere well to the various coatings described herein. In some embodiments, the underlying material of the barrel may be steel, stainless steel, metal ceramic matrix materials, alloys containing cobalt, or tungsten or molybdenum or any other material. In some embodiments, the underlying material of the barrel may be any material (e.g., including any of the foregoing materials) to which the coating may adhere.

In various embodiments, the coating of the bore 121 may comprise a metal material. For example, the coating may comprise chromium. Other example coatings may include cobalt, tungsten, nitriding, CVD-type coatings, or other high-temperature-resistant coatings. In one or more embodiments, the bore 121 may be coated in a stainless-steel alloy, wherein the stainless-steel alloy comprises chromium. In various embodiments, the bore 121 may be coated in chromium. In one or more embodiments, the chromium may be plated onto the bore 121 (e.g., including the rifling profile 125 with arcuate portions 102 and linear portions 101), via one or more electroplating processes. In one or more embodiments, the electroplating of a material containing chromium may cause one or more surfaces to become less angular (e.g., rounder) at joints between the arcuate portions 102 and the linear portions 101. In some embodiments, the coating may decrease the diameter of the barrel bore, and the various measurements herein, unless stated otherwise, include the final measurements of the completed barrel and coating together. During manufacturing, the barrel may be manufactured with a larger diameter prior to application of the coating or the barrel may be manufactured to the true target size and the barrel surface may be electro polished and/or etched away prior to application of the coating.

While traditionally barrel durability was considered to be at odds with firing performance, embodiments of the present disclosure may produce a more durable and better performing barrel than a standard barrel. In various embodiments, the flatform barrel rifling profile of an example barrel 100, such as the embodiment depicted in FIGS. 5-6B, provides greater accuracy and precision than standard rifling profiles barrels with improved durability both with and without coatings. For example, barrels 100 according to the dimensions disclosed herein and coated with chrome may experience greater accuracy and greater barrel life than an uncoated standard rifled barrel. In some embodiments, various barrels including flatform rifling profiles according to the embodiments discussed herein may show greater performance improvements for projectiles that traditionally do not fire well from standard rifling profiles. For example, projectiles that may contain small symmetry flaws and/or other aerodynamic issues may experience substantial performance improvements using embodiments of the barrel 100 discussed herein. Projectiles having a susceptibility to damage (e.g., lead jacketed projectiles) or projectiles having lower manufacturing quality may experience these symmetry flaws and/or other aerodynamic issues either due to damage that occurs within a standard barrel using standard rifling or due to inherent flaws in the projectiles. These flaws and issues may cause poorer accuracy and precision and may wear a standard barrel more quickly. Moreover, cartridges having higher pressure (e.g., .277 Fury or 6.8×51 mm cartridges) may also experience greater performance improvement using embodiments of the barrels 100 disclosed herein. In some embodiments, "higher pressure" may be defined as any cartridge configured to generate a higher pressure than the SAAMI maximum pressure. In particular, high pressure cartridges may quickly degrade a standard profile barrel but the reduced friction and reduced engraving between the projectile and the barrel 100 according to the present disclosure may improve accuracy and longevity for high pressure cartridges.

By way of non-limiting example, projectiles and cartridges having improved performance using embodiments of the barrels 100 disclosed herein may include: lead-jacketed projectiles or other projectiles having thick jackets which may engrave the rifling; projectiles with jackets that are not uniform in thickness; projectiles with lead not uniformly filling the jacket; lead-based projectiles with any jacketing errors, wherein this causes uneven thickness on projectile tips and/or mangled tips and/or lead not fully adhering; projectiles with exposed or truncated lead tips; lead-bottom projectiles (e.g., M855 and M193), which may traditionally have poor accuracy due to the projectile shape; projectiles (e.g., M855) having an enclosed steel penetrator; projectiles (e.g., M855A1) having an exposed penetrator and the like; and any other projectile and/or cartridge having similar properties to the examples described herein.

In various embodiments, the rifling profile may be made by machining. By way of example, the barrel 100 may be manufactured by taking a stock piece of steel and machining the interior and exterior surfaces. The barrel 100 and the bore 121, including the rifling profiles 125 discussed herein, may be created using one or more additive, subtractive, and/or forging techniques. For example, the rifling profile may be created by removing material along the length of the barrel in the shape of the rifling profile (e.g., cut rifling, button rifling, or broach rifling), or by shaping a billet into the final shape (e.g., hammer forging). The various barrel embodiments disclosed herein may be manufactured through various manufacturing processes, including, but not limited to, casting processes, broaching, or ECM.

The embodiments described herein may also be scalable to accommodate different sizes and configurations of firearms, different type of cartridges, and different sizes (e.g., lengths and diameters) of barrels. Various components of embodiments described herein can be added, removed, reorganized, modified, duplicated, and/or the like as one skilled on the art would find convenient and/or necessary to implement a particular application in conjunction with the teachings of the present disclosure. Moreover, specialized features, characteristics, materials, components, and/or equipment may be applied in conjunction with the teaching of the present disclosure as one skilled in the art would find convenient and/or necessary to implement a particular application in light of the present disclosure.

Many modifications and other embodiments of the present disclosure set forth herein will come to mind to one skilled in the art to which this disclosure pertains having the benefit of teachings presented in the foregoing descriptions and the associated drawings. Therefore, it is to be understood that the present disclosure is not to be limited to the specific embodiments disclosed and that modifications and other embodiments are intended to be included within the scope of elements and/or functions, it should be appreciated, in light of the present disclosure, that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purpose of limitation.

The invention claimed is:

1. A firearm barrel defining a center axis and configured to receive a bullet having a caliber, the firearm barrel comprising:

a body defining an outer surface and a bore, wherein the bore defines a rifling profile along at least a portion of a length of the firearm barrel, wherein the rifling profile defines a cross-sectional profile perpendicular to the length of the firearm barrel at a location along the length of the firearm barrel, wherein the cross-sectional profile comprises a plurality of arcuate portions and a plurality of linear portions, and wherein the cross-sectional profile defines a cross-sectional area defined by a Sporting Arms and Ammunition Manufacturers' Institute (SAAMI) standard rifling profile for the caliber.

2. The firearm barrel of claim 1, wherein at least a portion of the bore, including a first portion of the bore at the location, is coated with a coating.

3. The firearm barrel of claim 2, wherein the coating comprises chrome.

4. The firearm barrel of claim 1, wherein the plurality of arcuate portions and the plurality of linear portions comprise alternating arcuate portions and linear portions.

5. The firearm barrel of claim 4, wherein the plurality of arcuate portions and the plurality of linear portions comprise an equal number of the arcuate portions and the linear portions.

6. The firearm barrel of claim 5, wherein the plurality of arcuate portions and the plurality of linear portions comprise six arcuate portions and six linear portions.

7. The firearm barrel of claim 1, wherein a diameter of the bore spanning two opposite arcuate portions of the plurality of arcuate portions is defined as a diameter of a projectile for which the firearm barrel is sized.

8. The firearm barrel of claim 1, wherein the linear portions define a first radius at their closest point to the center axis at the location and the arcuate portions define a second radius to the center axis at the location, wherein the first radius is 97.5% to 97.8% of the second radius.

9. The firearm barrel of claim 8, wherein the rifling profile comprises an even number of the linear portions and an even number of the arcuate portions.

10. The firearm barrel of claim 1, wherein the linear portions define a first diameter at their closest point to the center axis at the location and the arcuate portions define a second diameter to the center axis at the location, wherein the firearm barrel is configured to receive a .277 Fury or 6.8 mm caliber bullet, wherein the first diameter is 0.270 and the second diameter is 0.277.

11. The firearm barrel of claim 1, wherein the firearm barrel is sized to fire M855 or M193 cartridges.

12. The firearm barrel of claim 1, wherein the cross-sectional area is 0.0388 square inches.

13. The firearm barrel of claim 1, wherein the cross-sectional profile comprises at least three and up to five arcuate portions and at least three and up to five linear portions.

14. The firearm barrel of claim 1, wherein the cross-sectional profile comprises three arcuate portions and three linear portions.

15. The firearm barrel of claim 1, wherein the bullet that the firearm barrel is configured to receive is a bullet from a high pressure cartridge.

16. A firearm comprising:

a receiver;

a trigger assembly;

a buttstock; and a barrel defining a center axis and configured to receive a bullet having a caliber, the barrel comprising:

a body defining an outer surface and a bore, wherein the bore defines a rifling profile along at least a portion of a length of the barrel, wherein the rifling profile defines a cross-sectional profile perpendicular to the length of the barrel at a location along the length of the barrel, wherein the cross-sectional profile comprises a plurality of arcuate portions and a plurality of linear portions, and wherein the cross-sectional profile defines a cross-sectional area defined by a Sporting Arms and Ammunition Manufacturers' Institute (SAAMI) standard rifling profile for the caliber.

17. The firearm of claim 16, wherein the plurality of arcuate portions and the plurality of linear portions comprise an equal number of the arcuate portions and the linear portions.

18. The firearm of claim 17, wherein the plurality of arcuate portions and the plurality of linear portions comprise six arcuate portions and six linear portions.

19. The firearm of claim 16, wherein the linear portions define a first radius at their closest point to the center axis at the location and the arcuate portions define a second radius to the center axis at the location, wherein the first radius is 97.5% to 97.8% of the second radius.

20. The firearm of claim 19, wherein the rifling profile comprises an even number of the linear portions and an even number of the arcuate portions.

* * * * *